US006128886A

United States Patent [19]

Johnson, Jr. et al.

[11] Patent Number: 6,128,886

[45] Date of Patent: Oct. 10, 2000

[54] HIGH SPEED INNER PACKING INSERTER

[75] Inventors: A. David Johnson, Jr., Malvern; Joseph L. Bachman, Jr., Villanova, both of Pa.

[73] Assignee: Wayne Automation Corporation, Norristown, Pa.

[21] Appl. No.: 09/289,470

[22] Filed: Apr. 9, 1999

[51] Int. Cl.[7] ..... B65B 43/30

[52] U.S. Cl. ..... 53/445; 53/472; 53/157; 53/263; 493/91

[58] Field of Search ..... 53/445, 452, 457, 53/472, 157, 238, 263, 246, 247, 564, 566; 493/90, 91, 312, 315, 391

[56] References Cited

U.S. PATENT DOCUMENTS 3,483,302 12/1969 Heyne ..... 493/91
3,651,614 3/1972 Corderoy ..... 53/445
3,952,633 4/1976 Nakai ..... 493/91
4,292,034 9/1981 Probyn et al. ..... 53/157
4,584,821 4/1986 Booth ..... 53/157
4,829,747 5/1989 Johnson, Jr. et al. ..... 53/457

*Primary Examiner*—John Sipos
*Attorney, Agent, or Firm*—Frederick J. Olsson

[57] ABSTRACT

A method for simultaneously creating a pair of inner packing and then simultaneously placing them into side-by-side cartons by pulling the lead inner packing from two sets of inner packings, moving the pulled inner packings towards each other until they are positioned side by side, gripping the inner packings and opening them and finally, while being gripped, moving the inner packings into the side by side cartons.

3 Claims, 2 Drawing Sheets

HIGH SPEED INNER PACKING INSERTER

This invention relates to the packaging art and in particular relates to the art of inserting inner packing in shipping cartons.

The invention contemplates a pair of spaced apart storage magazines and a pair of opener/inserter mechanisms positioned between the magazine in side-by-side relationships whereby collapsed partitions or flat scored blanks can simultaneously picked-off from a magazine and simultaneously moved toward each other to the respective opener/inserter mechanisms for simultaneous manipulation and insertion into side-by-side shipping cartons.

The primary object of the invention is to teach a way for greatly reducing the time to pick off or remove a collapsed partition or a flat blank from a storage magazine and effect insertion of same into a shipping case or carton for service as inner packing.

One advantage of the invention is that high through-put speeds can be attained without the necessity of running a machine at speeds which would cause early deterioration of components.

Additionally, there is an ergonomic advantage to the invention in that the very high through-put speeds are achieved with an extremely low rate of repetitive motions by a machine operator.

The invention will be described below in connection with the following drawings wherein.

Before proceeding we believe it desirable to define certain terms as used herein.

The term "shipping medium" refers to corrugated and solid fiber cartons or cases and for trays conventionally used for the transport of glass and plastic bottles and the other items.

The term "packing product" refers to collapsed multi-cell crossed-panel partitions and also to flat, scored panels or sheets.

The term "inner packing" refers to opened multi-cell crossed panel partitions, to partitions formed from scored panels, and to three or four-sided carton liners.

The term "scored" refers to panels having a notch, a cut out, or depressed-line employed for the purpose of bending the panel atop a desired axis.

The term "creating" refers to the operating of opening a collapsed multi-celled, crossed-panel partition and to the operation of converting a flat, scored panel into a cellular structure to form inner packing.

The term "open" will be understood to encompass the rotating of a collapsed multi-cell partition prior to insertion on a shipping carton and to the rotating or bending of portions or panels of a flat or folded blank prior to inserting in a shipping carton.

The term "manipulation" will be understood to refer to both the rotating of collapsed multi-cell portions and rotating or bending of portions or panels of flat blanks.

U.S. Pat. No. 4,829,747 which is owned by the assignee of this invention and application discloses methods and equipment for taking collapsed multi-cell partitions, opening the same and depositing in a shipping carton or on a medium for which the partition will serve its intended purpose.

As will be apparent from an inspection of the patent, the partitions are opened and inserted one at a time. In contrast thereto, the present invention inserts partitions two at a time.

As will be apparent from the description which follows, components disclosed in U.S. Pat. No. 4,829,747 can be employed for practicing the present invention and for constructing a machine to do so. Wherefore the disclosures in U.S. Pat. No. 4,829,747 are incorporated herein by reference.

Figure 1:
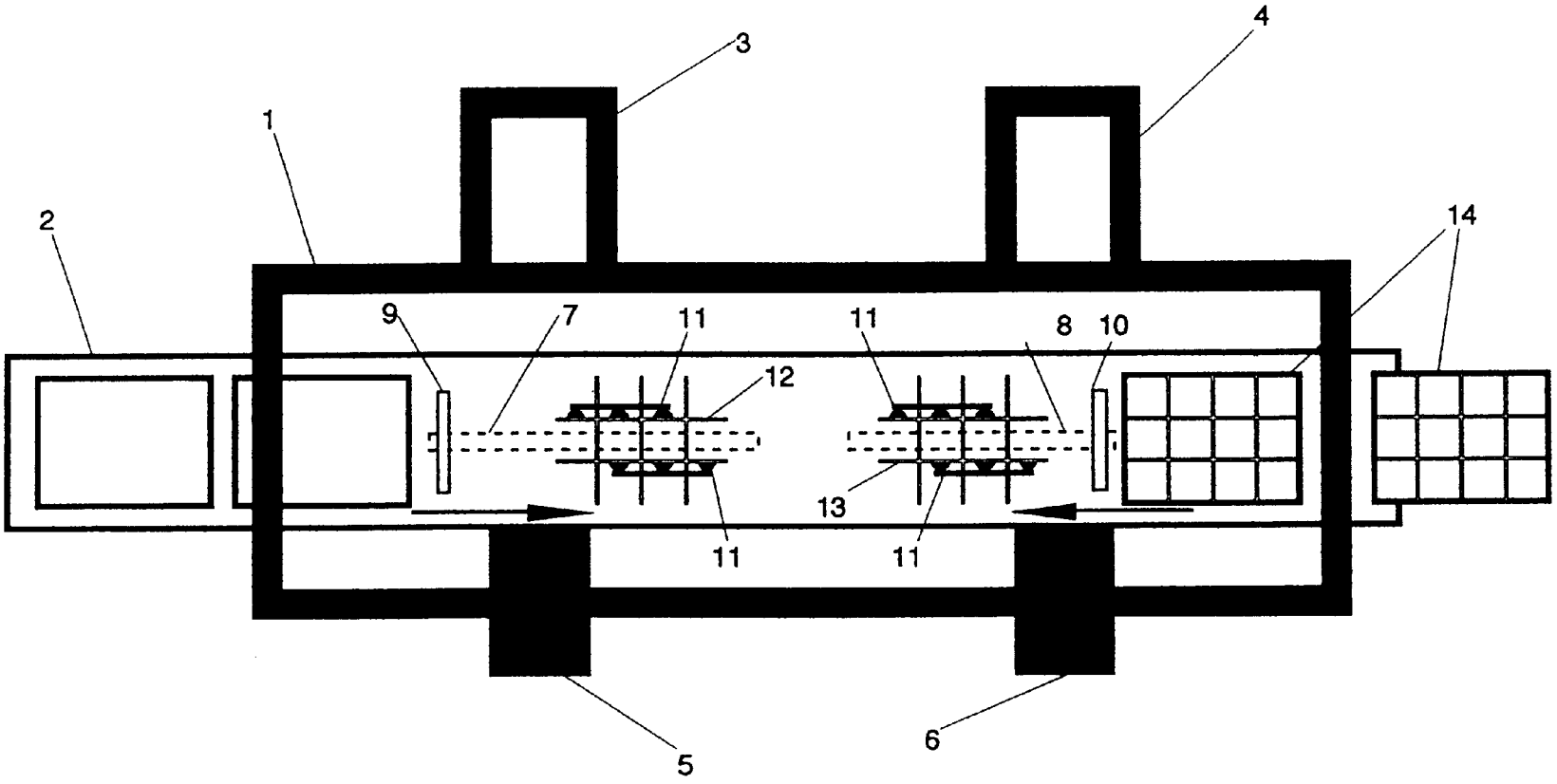
FIG. 1 is a plan view illustrating the arrangement of a machine employing the invention.

Referring now to FIG. 1 we have shown in somewhat diagramatic form the arrangement of a machine for practicing the invention. By comparing FIG. 1 herein with FIG. 3 in U.S. Pat. No. 4,829,747 it will be apparent that in some respects the machine of FIG. 1 is a double, so to speak, of the machine in FIG. 3. However, there are important differences, namely, the storage magazines are spaced apart and the opener/inserters are positioned side-by-side between the magazines. In this way partitions or panels can be simultaneously picked off from the magazines and simultaneously moved toward each other underneath the respective openers/inserts for simultaneous manipulation and insertion into a pair of cartons waiting below. The foregoing differences achieve the highly desirable increased through-put. An elongated frame is indicated by the numeral 1. The frame supports various of the components. A conveyer belt is indicated by the numeral 2. The belt moves cartons on other shipping medium from left to right.

A pair of spaced apart magazines are indicated by the numbers 3 and 4. The magazines are adapted to store packing product such as multi-cell collapsed portions on scored flat sheets or panels.

Pick-off or pull out mechanisms are indicated at 5 and 6. In each mechanism vacuum cups engage the lead collapsed partition or lead panel and pull the same out to the deposited or guide means. The guide means are indicated by numbers 7 and 8.

After the partitions or flat panels are deposited on the guide means pushers generally indicated at 9 and 10 are used to simultaneously move the partitions or panels along the guide means toward one another until the partition or panels are underneath the respective opener/inserters.

The pair of opener/inserter mechanism are not shown in FIG. 1. However, vacuum cups for developing the gripping forces to open and insert are indicated at 11. The opened partitions are indicated at 12 and 13.

A pair of cartons with inserted partitions are indicated at 14.

The transporter used in the machine of U.S. Pat. No. 4,829,747 is not employed in the machine disclosed herein. The instant machine uses a guide system the general structure and operation of which will be described in connection with FIG. 2.

A set of packing product (collapsed partitions or scored panels) is indicated at 15. Directly in front of the set is a fixed L-shaped guide number 16 which extends across the front of the magazine. The guide member 16 has a vertical 20 and a bottom 21. Adjacent to and extending along the bottom 21 is a moveable flap 22. In the position shown, the flap is below or flush with the bottom 21. The foregoing permits the lead packing product to be picked out of the magazine and pulled up against the vertical back 20 and is secured generally upright as follows.

The flap 22 is mounted for rotation from the position shown upwards so that it is over the bottom 21 and parallel to and spaced from the vertical back 20. The foregoing condition forms a channel wherein packing product is slidable mounted. The pusher means 9 can then move the packing product along the channel into a transition piece 23 and thence into a moveable channel 24.

The moveable channel 24 is positioned below the inserter/opener and holds the packing product mounted therein and oriented to be gripped by the suction cups of the opener/inserter.

The moveable channel is moved downwardly and transversely to the position indicated at 24*a*. The foregoing motion takes place after the packing product is gripped by the suction cups and allows the product to be manipulated and inserted by the opener/inserter.

It will be understood that where the packing product is a collapsed multi-cell partition an opener/inserter mechanism of the kind shown in U.S. Pat. No. 4,829,747 is employed.

As has been indicated, the invention can be practiced where the packing product is a flat, scored sheet or panel. This requires that flat panel be folded and bent to form the desired wings, beams and cells.

The fold may be the conventional double or triple fold and is done by using conventional folding tools at the time the flat panel is picked out of the magazine.

The bending is done at the insert station and this requires suction cups which rotate in opposite directions.

Figures 2, 3:
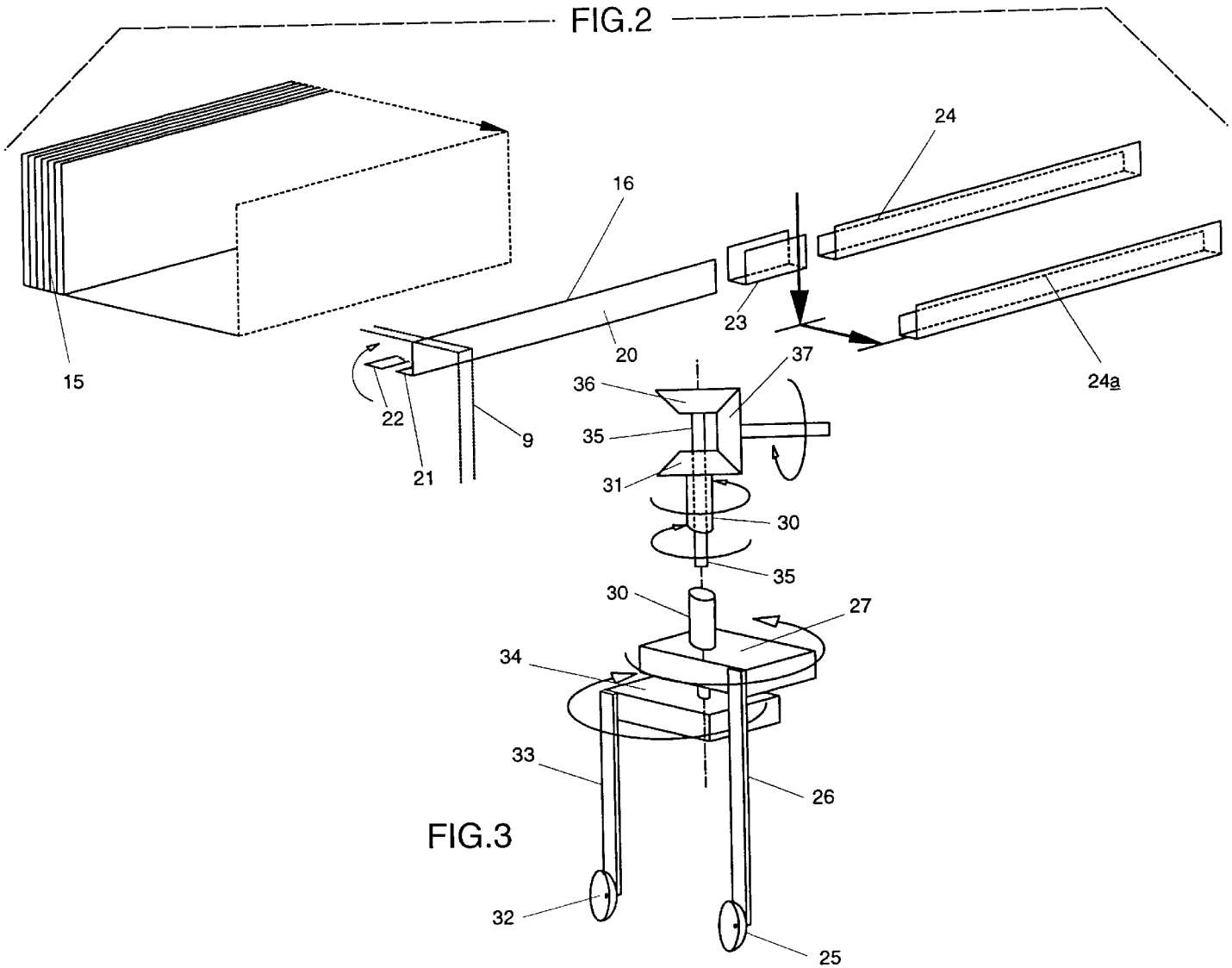
FIG. 2 is a fragmentary perspective view of a guide mechanism used in the machine of FIG. 1.
FIG. 3 is a view to illustrate a conventional mechanism for simultaneously rotating opener/inserter suction cups in opposite directions.

FIG. 3 illustrates a typical mounting arrangement for suction cups to be moved simultaneously in opposite directions.

A suction cup 25 is supported on a leg 26 connected to a head 27 which is rotated by a tubular shaft 30 fixed to a pinion 31.

The suction cup 32 is supported on a leg 33 connected to a head 34, an inner rod or shaft 35 extends up through to the tubular shaft 30 up through the pinion 31 and then fixed to a pinion 36.

The pinions 31 and 36 are rotated by drive pinion 37.

It will b apparent that when the drive pinion 37 is rotated the legs 26 at 33 (hence the cups 26 at 32) will be rotated in appropriate directions.

What is claimed is:

1. The method of simultaneously opening a pair of collapsed, multi-cell crossed-panel partitions and simultaneously inserting the opened partitions into respective shipping mediums in which the partition is to perform its intended function, the method comprising the steps of:

providing two sets of collapsed, multi-cell crossed panel partitions, the partitions in each set being in substantially upright positions and the partitions in each set respectively extending along horizontal axes which are co-planar, spaced apart, and parallel one another and the lead partition in each set being in a pull-out station;

for each said set, simultaneously developing gripping force on the lead partition and pulling the lead partition out of the pull-out station to a transfer station wherein the partition is in an upright position and extends along a horizontal transfer axis which is normal to said horizontal axes of said sets;

simultaneously applying force to the partitions in the respective transfer stations to move the partitions toward one another along said transfer axis to respective opening stations which are positioned side-by-side one another;

in each opening station simultaneously applying gripping force to selected panels of the partition in the station and causing said gripping force to be displaced in a horizontal plane whereby to rotate the panels and effect opening of the partition;

providing a pair of shipping mediums respectively at insert stations respectively underneath said opening stations; and at each opening station and while maintaining last said gripping force causing downward movement of the gripping force to an insert station and deposit the opened partition on said shipping mediums to serve as inner packing.

2. The method of simultaneously forming a pair of inner packing and simultaneously inserting the inner packing into respective shipping mediums in which the inner packing is to perform its intended function, the method comprising the steps of:

providing two sets of flat, scored panels, the panels in each set being substantially in upright positions and the panels in each set respectively extending along horizontal axes which are coplanar, spaced apart and parallel one another and the lead panel in each set being in a pull-out station;

for each set, simultaneously developing gripping force on the lead panel and pulling the lead panel out of the pull-out station while at the same time causing the lead panel to be moved around a fold axis normal said horizontal axis whereby the panel is folded in half, the folded panel then being in a transfer station in an upright position and extending along a horizontal transfer axis which is normal to said horizontal axes;

simultaneously applying force to the folded panel in the respective transfer stations to move the folded panels toward one another along the transfer axis to respective opening stations which are positioned side-by-side one another;

in each opening station, simultaneously applying gripping force to pre-selected portions of the folded panel to bend the portions around axes normal to said fold axis;

providing a pair of shipping mediums respectively underneath said opening stations; and at each opening station, subsequent to said bending and while maintaining said gripping force on the portions causing the gripping force to move downwardly to an insert station and thereby depositing the folded and bent panel on said shipping medium to serve as inner packing.

3. A method of simultaneously creating a pair of inner packing and then simultaneously placing the inner packing into side-by-side shipping cartons, the method comprising;

providing two sets of packing product, the product in each set being substantially in upright positions and the product in each set respectively extending along horizontal axes which are coplanar, spaced apart, and parallel to one another and the lead product in each set being in a pull-out station;

for each set, simultaneously developing gripping force on the lead packing product and pulling the lead product out of the pull-out station;

for each lead packing product, applying forces to respectively move the products toward one another until the same are positioned side by side;

applying gripping force respectively to portions of said side-by-side packing product to bend the portions around vertical axes; and after said bending and while maintaining said gripping forces causing the gripping forces to move downwardly to deposit the packing product respectively in side-by-side shipping cartons.

* * * * *